United States Patent [19]

Frochaux

[11] B 3,985,302

[45] Oct. 12, 1976

[54] VARIABLE TWO STAGE AIR NOZZLE

[75] Inventor: Alain Frochaux, Boston, Mass.

[73] Assignee: Barry Wright Corporation, Watertown, Mass.

[22] Filed: June 12, 1975

[21] Appl. No.: 586,215

[44] Published under the second Trial Voluntary Protest Program on January 20, 1976 as document No. B 586,215.

[52] U.S. Cl. ..... 239/424; 239/DIG. 7; 239/DIG. 21; 239/DIG. 22; 239/291; 239/587; 181/50; 181/51

[51] Int. Cl.[2] ..... B05B 7/08; B05B 1/30; F01N 1/10; F01N 1/14

[58] Field of Search ..... 181/33 HC, 33 HD, 42, 181/43, 36 A, 50, 51, 71, 64 B, 65; 239/DIG. 7, DIG. 21, DIG. 22, 291, 314, 418, 422–424, 424.5, 587, 588, 265.13

[56] References Cited

UNITED STATES PATENTS

| | | | |
|---|---|---|---|
| 2,293,181 | 8/1942 | Terman | 181/71 X |
| 2,334,263 | 11/1943 | Hartwell | 181/42 X |
| 2,797,964 | 7/1957 | Alexander | 239/422 X |
| 3,117,726 | 1/1964 | Schoberg | 239/291 |
| 3,318,534 | 5/1967 | Stolteben | 239/291 |
| 3,628,737 | 12/1971 | Norton | 239/DIG. 7 |
| 3,735,778 | 5/1973 | Garnier | 239/DIG. 7 |
| 3,794,137 | 2/1974 | Tydorescu et al. | 239/DIG. 7 |
| 3,795,288 | 3/1974 | Pall | 181/71 X |
| 3,829,020 | 8/1974 | Stearns | 239/265.13 |
| 3,859,205 | 1/1975 | Reba et al. | 239/DIG. 7 |

FOREIGN PATENTS OR APPLICATIONS

| | | | |
|---|---|---|---|
| 1,408,538 | 7/1965 | France | 239/291 |

*Primary Examiner*—Robert S. Ward, Jr.
*Attorney, Agent, or Firm*—Milton E. Gilbert

[57] ABSTRACT

An improved air nozzle is provided which produces high thrust amplification over a relatively wide range of input flow rates while maintaining relatively low noise levels. The nozzle is adapted to provide flow amplification by inducing flow of ambient air with high pressure air.

15 Claims, 5 Drawing Figures

VARIABLE TWO STAGE AIR NOZZLE

This invention relates to fluid delivery nozzles and more particularly to nozzles which exhibit high thrust and low noise.

Various types of fluid delivery nozzles have been proposed for use in manufacturing establishments where a stream of air is directed to perform a function such as ejecting parts or blowing refuse from a machine or work station. In such applications, it is desirable that the stream be concentrated and that the working force of the stream be substantial. It is also desirable that the noise levels not be excessive. One type of nozzle which has been considered which produces high thrust and low noise levels is described in my copending U.S. patent application Ser. No. 580,921 filed Aug. 26, 1974 which is a continuation-in-part of my U.S. patent application Ser. No. 500,647 filed Aug. 26, 1974, now abandoned.

The nozzles described in the aforesaid copending U.S. application make use of a modification of the Coanda or wall attachment principle to entrain ambient air in a high velocity small mass air stream. As disclosed in U.S. Pat. Nos. 2,052,869 and 3,047,208 and as exemplified in nozzle applications by U.S. Pat. Nos. 3,743,186, 3,801,020, 3,806,039 and 3,705,367, the Coanda effect basically involves discharging a small volume of a primary fluid under a high velocity from a nozzle having a shaped surface adjacent the nozzle, whereby the stream of primary fluid tends to follow the shaped surface and as it does, it induces a surrounding secondary fluid — notably, ambient air — to flow with it along the shaped surface. The result produces an exhaust stream which combines both fluids. Thus, nozzles constructed in accordance with the principles established by Coanda exhibit high thrust due to the amplification in flow produced by the Coanda effect.

The nozzles described in my above-noted copending application feature amplification of air flow produced by the Coanda effect and at the same time provide reduced noise levels. In one embodiment, the nozzle is a single stage amplification device which comprises an inlet for connection to a source of high pressure air, an air passageway for conducting an air stream from the inlet to the nozzle discharge opening, at least one port intermediate the inlet and the discharge opening for conducting pressurized air out laterally from the passageway, and means including an appropriately shaped outer nozzle surface for causing the compressed air exiting the port to induce a flow of ambient air along the outer surface of the nozzle toward the nozzle's exit end so as to provide a working stream which combines the pressurized air discharged from the main passageway and the induced ambient air. Since the mass of the resulting working stream is greater than that of just the pressurized air stream which exits the passageway, it accordingly enhances the working force of the combined stream substantially over that of only the discrete pressurized air stream which exits the passageway. A selected air-permeable flow-modifying element is disposed in the air passageway for the purpose of causing the stream flowing in the passageway to assume a laminar or near-laminar flow characteristic, whereby to reduce noise while at the same time permitting the air stream in the passageway to exit the nozzle at a high velocity. The flow-modifying element also provides a back pressure which forces air to exit the passageway via the port(s) whereby to promote the desired induction of ambient air. In a second embodiment I describe a two-stage amplification nozzle which is basically the same as the single stage device, but modified to include a second stage element. The two-stage amplification nozzle provides increased thrust over the single stage nozzle while maintaining relatively low-noise levels.

It has been determined that the air volume entrainment is not only a function of the velocity of the air stream exiting from the side ports but is also proportional to the length over which the inducing air stream moves before entering the main stream of the nozzle. However, in both of the aforementioned embodiments the length of the outer-surface over which the air streams exiting the ports must travel is fixed. As a consequence, a fixed optimum relationship can be achieved between the output thrust and the input flow rate. If the latter is increased substantially from the level at which the optimum condition is achieved, the output thrust will increase at a rate slower than the rate of increase before reaching optimum.

Accordingly, it is the primary object of the present invention to provide an improved amplification air nozzle of the type described which will maintain an optimum relationship between the output thrust and the input flow rate through a large range of input flow.

A further object is to provide a nozzle of the type described which has a higher output thrust capability per given input flow than is possible with nozzles of the type described in my copending application.

Another object of the present invention is to provide an improved air nozzle which automatically increases ambient air entrainment with increases in the input flow rate over a large range of input flow.

A further object of the present invention is to provide an improved air nozzle of the type described in which the length over which the air stream moves along the outer surface before entering the main air stream of the nozzle varies with the rate of input flow.

Yet another object of the present invention is to provide an improved air nozzle of the character described, which is extremely simple in construction, reliable and durable in use and economical to manufacture.

The foregoing objects and other objects hereinafter disclosed or rendered obvious are achieved by an improved nozzle which comprises an inlet for connection to a source of high pressure air, an air passageway for conducting an air stream from the inlet to a nozzle discharge opening, one or more ports intermediate the inlet and the discharge opening for conducting pressurized air out laterally from the passageway, and means including an appropriately shaped outer nozzle surface for causing the compressed air exiting the one or more ports to induce a flow of ambient air along the outer surface of the nozzle toward the nozzle's exit end so as to provide a working stream which combines the pressurized air discharged from the main passageway and the induced ambient air. The improved nozzle further includes means for varying the length of the outer surface of the nozzle over which the air exiting one or more of the ports must travel, as a function of the input flow rate. Since the mass of the resulting working stream increases with the length of the outer surface over which the air exiting one or more of the ports travels, the optimum relationship between the enhanced output and the flow input is maintained over a relatively greater range of inputs. A selected air-permeable flow-modifying element is disposed in the passageway for the purpose of causing the stream flowing in the passageway to assume a laminar or more nearly laminar flow characteristic without any substantial drop in air pressure, whereby to reduce noise while at the same time permitting the air stream in the passageway to exit the nozzle at a high velocity. The flow-modifying element also provides a back pressure which forces air to exit the passageway via the one or more ports whereby to promote the desired induction of ambient air.

Other features and many of the attendant advantages of this invention are disclosed by the following detailed description which is to be considered together with the accompanying drawings wherein.

The same numerals are used in the several figures to designate identical parts.

Figure 1:
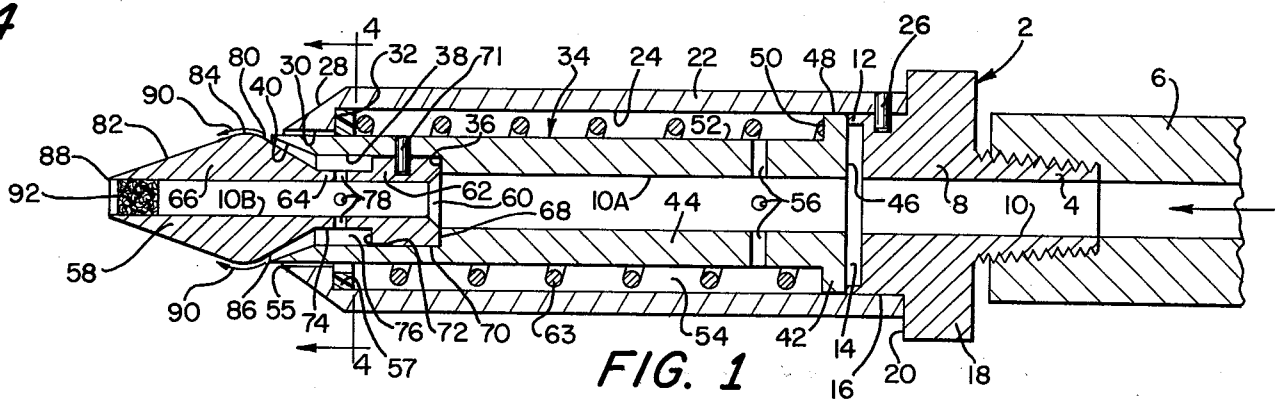
FIG. 1 is a longitudinal section of a preferred embodiment of the invention.

Turning to FIG. 1, the illustrated nozzle comprises a plug 2 which has a reduced diameter threaded extension 4 at its rear or inlet end for connection to a conduit 6, the latter leading to a source (not shown) of a pneumatic medium such as compressed air. The main portion of the plug, which is at the forward or outlet end thereof, is in the form of a cylindrical body 8. The body 8 and the threaded extension 4 have a common, centrally located and smooth surfaced bore 10 that has a circular cross-section and serves as an inlet and flow passageway for the pressurized pneumatic medium. The forward end of the body 8 is counterbored so as to form an annular flange 12 and a recess 14. The body 8 also includes an outer cylindrical surface 16 and a radially-directed annular flange 18 which extends outwardly from the surface 16 to form an annular shoulder 20.

Attached to the plug 2 is a forwardly extending hollow cylindrical housing or sleeve 22. The latter has a smooth inner cylindrical surface 24 which is coaxially aligned with bore 10 and sized to make a tight friction fit with the outer surface 16 of the plug 2, while its rear end surface contacts the shoulder 20. A roll pin 26 extends radially through the sleeve 22 into the plug 2 to insure that the sleeve 22 will remain secured to plug 2 when the nozzle is connected to a source of high pressure air. The forward end of sleeve 22 is bevelled to provide a frusto-conical outer surface 28. The forward end of sleeve 22 is provided with an inner cylindrical surface 30 which is of a reduced diameter and coaxially aligned with the cylindrical surface 24. The surfaces 24 and 30 are joined together by an inner radially-directed shoulder 32.

A tubular member, identified generally at 34, is coaxially and slidably mounted within sleeve 22. Member 34 has a centrally located smooth surfaced bore 10A that is the same diameter as and is aligned with bore 10. The element 34 is also counterbored at its forward end to provide an inner radially-directed annular 36 and an inner cylindrical surface 38. The inside of the forward end of element 34 is provided with a frusto-conical surface 40 which forms an outwardly tapered or flared opening for the tubular member. The exterior of tubular member 34 comprises a flange portion 42 at its rear or upstream end and a main portion 44. Flange portion 42 has a flat annular rear surface 46, a cylindrical outer surface 48 and a flat annular front end surface 50. Surface 48 is sized so that the member 34 can freely move axially with respect to the inner surface 24 of sleeve 22. The main portion 44 has a cylindrical outer surface 52 that has a smaller diameter than surface 48 so as to provide an annular chamber 54 between it and the sleeve 22. The diameter of the surface 52 is also made smaller than the inner cylindrical surface 30 of the shell so as to provide an annular passageway or orifice 55 between the two surfaces. By way of example, in the preferred embodiment of the invention, the gap between surfaces 30 and 52 is between about 0.003 and 0.008 inch.

Additionally, the main portion has at least one and preferably several ports 56 which are positioned between the flange 42 and the annular shoulder 36 and lead from bore 10A to chamber 54. Preferably, but not necessarily, ports 56 are closer to flange 42 than shoulder 36 and their axes extend at a right angle to bore 10A.

Figure 4:
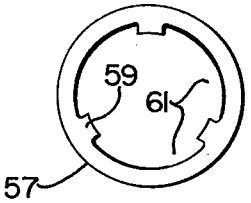
FIG. 4 is a cross-sectional view of the guide ring of the FIG. 1 embodiment.

In order to help maintain tubular member 34 coaxial with sleeve 22, a guide ring 57 is provided between them at the forward end of the sleeve. The guide ring is sized to make a tight friction fit with the inner surface 24 of sleeve 22 and, as shown in FIG. 4, the inside of the ring is preferably provided with three inwardly-extending radially-directed segments 59 which are equiangularly spaced around the guide tube and define slots 61. The segments 59 are dimensioned to have first enough clearance with the tube member 34 so that the latter can move freely through the ring. The slots 61 provide air gaps between ring 57 and the tube member connecting the chamber 54 with the orifice 55. In the preferred embodiment of the invention, the internal diameter of each slot is made 0.020 inch larger than the outside diameter of the tube member 34.

In order to maintain the ring 57 at the forward end of the sleeve 22 and the tube member in the retracted position, biasing means in the form of a compression coil spring member 63 is provided. The spring member 63 is positioned in the chamber 54 so that one end urges ring 57 against the inner shoulder 32 and its other end contacts the surface 50 of flange portion 42. Spring 63 acts to keep the rear surface 46 of flange 42 against the annular front end flange 12 of plug 2. Spring member 63 is sized so that it can be compressed and relaxed without being binded by the inner surface 24 of sleeve 22 and the external surface 52 of tube member 34. The spring constant of member 63 is selected according to the maximum pressure of the fluid introduced through conduit 6, as will be more apparent hereinafter.

Secured to the downstream end of tubular member 34 is a nozzle element identified generally as 58. The latter has a centrally located smooth-surfaced bore 10B that is of a smaller size than and is aligned with bore 10A. Nozzle element 58 comprises an end section 62, a throat section 64, and a main section 66. End section 62 has a flat annular rear surface 68, a cylindrical outer surface 70, and a flat annular front end surface 72. Surface 70 is sized to make a tight friction fit with the inner surface 38 of the tubular element 34. At least one roll pin 71 is used to insure that the nozzle element 58 remains fixed with respect to tubular element 34. The roll pin extends radially through the tubular element 34 into a blind hole in the end section 62 of the nozzle element. Throat section 64 has a cylindrical outer surface 74 that has a smaller diameter than surface 72 whereby to provide a second annular chamber 76 between it and the tubular element. Additionally, the throat section has at least one and preferably several ports 78 that lead from bore 10B to chamber 76. Preferably, but not necessarily, the axes of ports 78 extend at a right angle to bore 10B.

The exterior of main section 66 has a generally bulbous shape characterized by a rear frusto-conical surface 80, a front frusto-conical surface 82, and a convex circumferentially-extending transition surface 84. The nozzle section is sized so that its rear surface 80 is spaced from the adjacent surface 40 of the tubular element. Preferably, the shape of the rear frusto-conical surface 80 is linear and is set so that, with increasing distance from throat section 64, it converges toward the adjacent surface 40 of the tubular element, whereby to form an annular passageway or orifice 86 that communicates with chamber 76, and whose cross-sectional area decreases progressively with increasing distance from chamber 76. Preferably, but not necessarily, the axial length of the outer surface of the annular throat section is set so that its junction with surface 80 is aligned radially with the junction of surfaces 38 and 40 of the tubular element, as shown. The frusto-conical surface 80 preferably is long enough so that its forward end projects radially to or beyond the outer surface of the tubular element, whereby the transition surface 84 is in position to intercept ambient air flowing along the outer surfaces of the shell 22 and tubular element 34 toward the nozzle element 58. The surface 82 is formed so that its front end terminates close to the axial bore 10B. Preferably, its front end intersects or nearly intersects the axial bore so that the nozzle element has a relatively narrow front edge as shown at 88. While a relatively thin knife edge may be advantageous for optimum merging of ambient air with the air stream exiting from bore 10B, it is preferred that edge 88 be somewhat blunt so as to minimize possible injury to workmen. In any event, the slope and length of surface 82 are set so that the induced ambient air and the pressurized air stream from bore 10B will merge in a smooth transition without the creation of noise producing eddies and vortices.

It is also essential that the slopes of confronting surfaces 40 and 80 and the minimum gap therebetween be set so that air will exit the orifice 86 as a thin film which will tend to adhere to and flow along surface 80 over surface 84 and along surface 82 in the manner shown by the arrows 90. By way of example, in a preferred embodiment of the invention, the surface 82 has a slope of about 20° with respect to the common axis of bores 10, 10A, and 10B, surfaces 40 and 80 have slopes with respect to the same axis of 20° and 30° respectively, and the gap between surfaces 40 and 80 is between about 0.003 and 0.008 inch.

It is also essential, for better promotion of laminar flow and to reduce noise, that the bore 10B have a diameter substantially the same as or smaller than bore 10A, since this arrangement provides a smooth transition from bore 10A to bore 10B and thus avoids or minimizes creation of eddies and turbulence in the air stream as it passes into bore 10B from bore 10A.

Also forming part of the nozzle assembly is a flow-modifying noise-reducing element 92 which is essentially a cylindrically shaped plug and preferably, but not necessarily, is formed with flat end surfaces as shown. Noise-reducing element 92 is made of a knitted wire mesh fabric and may be formed in situ or preformed and installed after formation.

Figure 3:
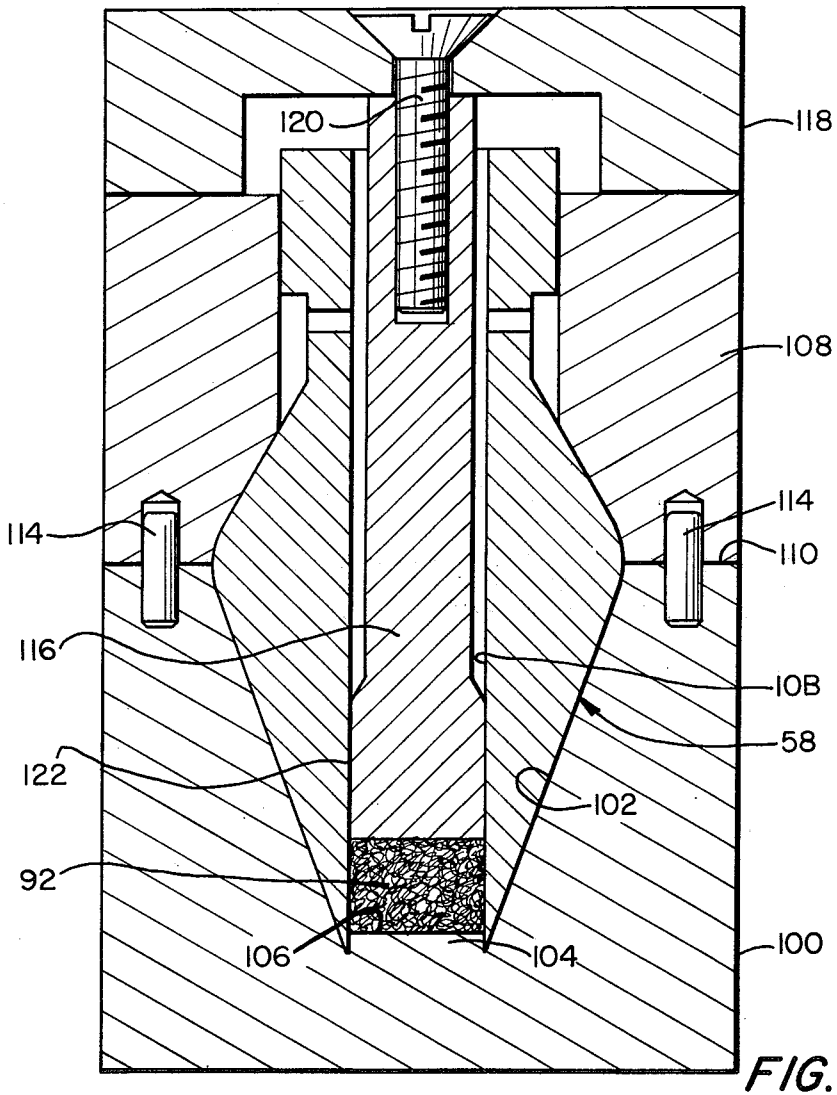
FIG. 3 is a sectional view of a die for forming the flow-modifying element.

The element 92 is made generally in accordance with the teachings of U.S. Pat. No. 2,334,263 issued Nov. 16, 1943 to R. L. Hartwell for Foraminous Body and Method of Producing Same. Element 92 consists of a compressed mass of metal wire characterized by a closely packed, interlocked wire structure that forms a coherent body. The element is fabricated from knitted metal wire mesh of selected gauge. The mesh may be knit flat or tubular and may be of selected mesh loop size. Preferably it is knitted as a tube or sock on a circular knitting machine. In its simplest form, the knitted wire mesh tube may be knitted from a single continuous length of metal wire which is so manipulated as to form a continuous tube in which successive turns of the wire form lengths which extend circumferentially of the tube and are interlocked by stitches. Each length is bent locally beyond its elastic limit as a result of the formation and interlocking of loops or stitches as the tube is knitted. Thus each circumferential length, in effect, forms a flattened spring which may be stretched or compressed. The finished tube or sock is flattened longitudinally so as to form a two-ply ribbon. Preferably, but not necessarily, the flattened tube may be corrugated traversely to provide further interlocking between the lengths of wire in the plies thereof. Corrugating the fabric is known in the art as "crimping" and the product is commonly called "crimped knitted wire mesh fabric". The tube may be corrugated at a right angle to its axial length or at a different angle, e.g., 45°, in the manner disclosed by the Hartwell patent. FIG. 3 presents a side view of a portion of a knitted wire mesh fabric tube as above described. The fabric is seen to comprise circumferential turns of wire 94 with each turn having loops or stitches which are interlocked with adjacent turns. In this case, the fabric is crimped along spaced diagonal lines 96.

Knitted wire mesh fabric and the method of making the same are well known (in this connection see also U.S. Pats. Nos. 3,346,302, 2,680,284, 2,869,858 and 2,426,316).

In the practice of this invention, the knitted wire mesh fabric is preferably made of a stainless steel wire, although other steels and alloys may be used.

Figure 2:
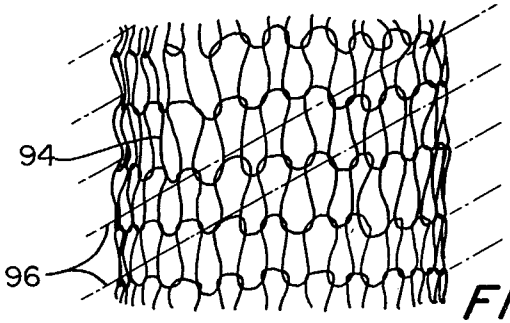
FIG. 2 is a diagrammatic view on an enlarged scale of a piece of knitted metal wire mesh.

Preferably the flow-modifying element 92 is made by flattening a knitted wire mesh fabric tube upon itself to form a flat two-ply ribbon, and then rolling the ribbon upon itself. The ribbon is wound up in the manner shown in FIG. 2 of U.S. Pat. No. 3,346,302 (except that it is not wound upon a mandrel) and FIG. 2 of the Hartwell patent, with the result that the rolled up body is generally cylindrical and the width or transverse dimension of the ribbon extends parallel to the body's longitudinal axis. More specifically, the cylindrical body consists in cross-section of a continuous spiral convolute. In this generally cylindrical body the lengths of wire making up each turn of the fabric tube are now largely so oriented as to extend from one end of the body to the other in directions generally parallel with the body's longitudinal axis. This cylindrical body is then compressed and molded into a flow-modifying noise-reducing element of desired density and shape.

FIG. 3 shows a forming die assembly made of tool steel for forming the element 92 in situ. The forming die assembly comprises a stationary die 100 having a cavity 102 shaped to receive the forward portion of the main section 66 of the nozzle element and a cylindrical extension 104 at the base of the cavity which is sized to fit snugly within the bore 10B. The upper surface of extension 104 has a flat end surface 106. A die sleeve 108 fits down over the rear portion of main section 66 and seats on the flat upper surface 110 of die 100. Sleeve 108 makes a close fit with the surfaces 82 and 70 of the nozzle element and is held against lateral movement by dowels 114 which are embedded in the upper surface 110 of the die and make a sliding fit in holes in the sleeve. The die assembly also comprises a piston unit consisting of an elongate piston 116 and a piston head 118 secured to the piston by a screw 120. The bottom end of piston 116 is enlarged and has a cylindrical outer surface 122 sized to make a close sliding fit with bore 10B.

In molding the element 92 in situ, the die assembly is mounted in a press (not shown) having a stationary bed and a vertically reciprocal pressure head, with the die member 100 being fixed to the bed and the piston assembly being mounted to the pressure head in vertical alignment with the die member. With the die assembly open, the nozzle element 58 is inserted in the cavity of die 100 and sleeve 108 is positioned as shown so as to hold the nozzle element centered. Then the rolled-up or folded knitted wire mesh fabric is inserted into the upper end of the nozzle element and the piston unit is operated to drive the fabric body into the housing. The length of knitted wire mesh fabric tube employed in forming the element 92 is set so that when the element is formed it has a density which is a predetermined percentage of the density of the metal of which the wire mesh fabric is made. The cylindrical wire mesh body formed by rolling up the flattened wire mesh fabric tube is inserted in the bore 10B so that the rolled up layers of the wire mesh fabric tube extend axially of and are compressed radially by the surrounding surface of the nozzle element, i.e., the cylindrical knitted mesh body is inserted so that its axis of convolution extends parallel to the axis of bore 10B. The fabric body is compressed and molded by the compressive co-action of die extension 104 and the end of the piston 116. The extent of penetration of the piston unit determines the final size and density of the mass 92 of knitted wire mesh fabric, and preferably the desired density is achieved when the piston unit bottoms on the upper end of die sleeve 108. The formed element 92 and housing nozzle element 58 are tightly gripped together by a friction fit and the element is self-supporting and has excellent structural integrity.

The nozzle element in the embodiment just described is preferably made of material that is softer than the material of which the element 92 is made. Preferably, nozzle element 58 is made of aluminum or an aluminum alloy while element 92 is made of stainless steel knitted wire mesh. As a consequence, as the element 92 is formed in situ, portions of the wire of which it is made will abrade and in some places actually cut into the interior surface of the nozzle element, with the result that the element is mechanically interlocked with the housing. Additionally, the formed element has a certain amount of spring action and as a consequence, it exerts a radial force against the surrounding nozzle element which further improves the mechanical gripping action between the two parts. A connection of almost equal strength can be achieved between the nozzle and element 92 where the latter is preformed since the preformed element also has a certain spring action. Accordingly, by making the preformed element slightly oversized, it is possible to assure a strong press-fit connection to the nozzle element. Again due to the difference in materials hardness, as the preformed element is forced into bore 10B, portions of the wire of which it is formed will abrade and cut into the interior surface of nozzle element 58 so that it is mechanically interlocked with the nozzle element.

As the rolled up or convoluted body of knitted wire mesh fabric is compacted and molded into the element 92, it is tightly compressed in directions transverse to the width of the flattened tube or ribbon, i.e., it is compressed both radially and axially, with the result that the turns or length of wire are crimped at innumerable points beyond their elastic limits so that they take a more or less permanent set. Additionally, as the wire mesh fabric is compressed, the wire is so deformed as to produce a compressed mass or body consisting of a very great number of uniformly distributed, randomly directed, relatively short spans or lengths of wire which contact each other at innumerable points within the mass, with the result that these spans or lengths are intimately interlocked substantially uniformly throughout the entire volume of the mass with portions of the spans of wire being spaced to form small pockets and passageways of capillary size. The net result is a relatively dense yet porous cohesive or self-supporting body consisting of fine, intermingled and interconnected spring wire spans which are capable of some movement relative to one another in response to absorbed energy. This self-supporting body is characterized by substantial structural integrity, controlled density, a uniform and fine porosity, and a controlled spring constant. The multiplicity of short spans of wire, the uniformity of distribution and random directions of such spans, and the innumerable points of contact between them, all contribute to the capability of the element to modify the flow of air through bore 10B so that it will exit the nozzle as a laminar flow jet stream.

The plug 2, sleeve 22, tubular member 34, and spring member 63, may be made of the same material as the nozzle element or a different material. Thus, for example, if nozzle element 22 is made of aluminum, any one of or all of the plug, sleeve, tubular member and spring member may be made of aluminum or stainless steel. The sleeve 22 and tubular member 34 may be, and preferably are, secured respectively to the plug 2 and nozzle element 58 by a press-fit as previously described, or it may be secured by other means known to persons skilled in the art. The guide ring 57 is preferably made of a hard, durable plastic material such as polyvinyl chloride, which can easily withstand the compression forces of the spring 63.

Figure 5:
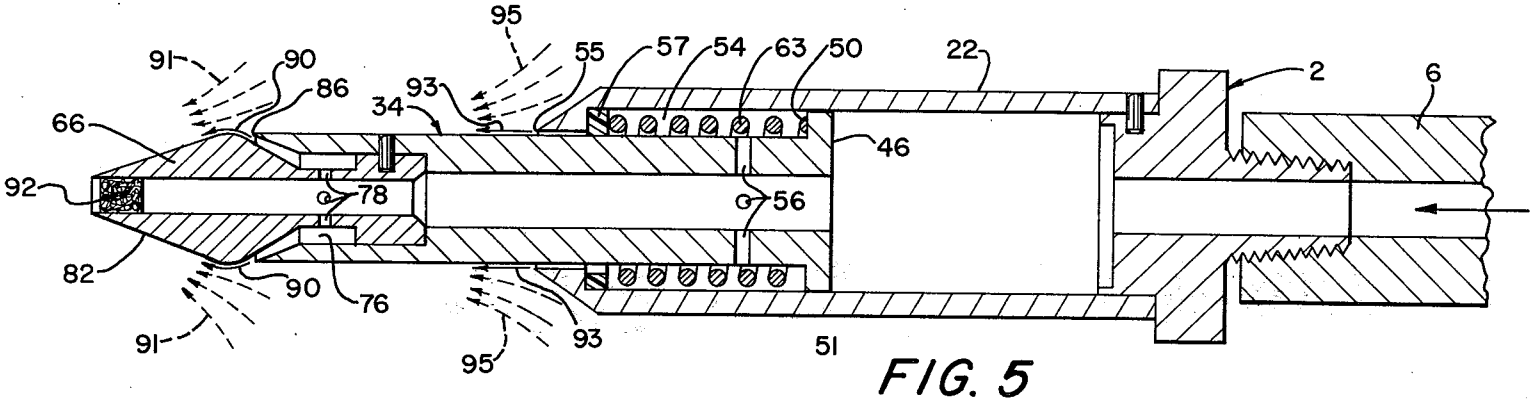
FIG. 5 is a longitudinal section of the FIG. 1 embodiment in a partially extended position.

Operation of the device of FIG. 1 as an air nozzle will now be described with reference to FIG. 5. Assume that conduit 6 is connected to a regulated source of air under pressure, e.g., 100 psi, through a flow rate control valve. The compressed air enters the nozzle through the conduit 6, flows along bores 10, 10A and 10B and through element 92, and escapes via the exit orifice defined by annular end surface 88 of the nozzle element. Since the wire mesh plug 92 offers some resistance to free flow of the compressed air, a back pressure is created upstream of the element. Consequently, part of the pressurized air supplied to the bore 10B is diverted out of that bore through ports 78 into chamber 76 and then flows out of chamber 76 via the small gap annular orifice 86 formed between the surfaces 40 and 80. In passing out of this small gap orifice, the pressurized air forms a very thin film moving at a high velocity. Since air moving at a high velocity has a static pressure less than atmospheric pressure, a differential pressure effect in the form of a partial vacuum is created which on one side makes the air film cling to and follow the exterior contour of the nozzle element 58 as shown by arrows 90, and on the other side draws in ambient air as shown by arrows 91. The thin air film and the induced ambient air flow together along surface 82 and merge with the air stream discharged from bore 10B, thus in effect amplifying the air flow directed by the nozzle. It is to be noted that transition surface 84 acts to guide the air flowing out of orifice 86.

In addition to part of the pressurized air being diverted through ports 78, the back pressure created upstream of the element 92 also causes some of the air to be diverted out of the bore 10A through ports 56 into chamber 54. This diverted air then flows through the gaps provided by the slots 61 of guide ring 57 and hence through the small gap annular orifice 55 formed between the surfaces 30 and 52. In passing out of this small gap orifice, the pressurized air forms a second high velocity thin film. The latter has a static pressure less than atmospheric pressure, and thus a partial vacuum is created which makes the air film on one side cling to and follow the surface 52 as shown by arrows 93 and on the other side draws in additional quantities of the ambient air surrounding the device as shown by arrows 95. The resulting combination of the thin air film and induced ambient air flows along the exposed portion of surface 52 and merges with the air stream discharged from the annular orifice 86, thus in effect further amplifying the air flow directed by the nozzle.

The back pressure produced by the flow modifying element 92 also assures a pressure buildup in recess 14 between the annular rear surface 46 of member 34 and the adjacent surface of plug 2. The pressure in recess 14 provides a force on the surface 46 of tubular member 34 which is greater than the force on the annular front surface 50 of flange 42 provided by the pressure in chamber 54. This results from the fact that the area of surface 46 is greater than the area of surface 50. Also the pressure in chamber 54 tends to be less than the pressure in recess 14 due to the pressure relief afforded by flow through the orifice 55. This difference in forces has the effect of causing the tubular member 34 together with the attached nozzle element 58 to move forward with respect to sleeve 22 against the bias of spring member 63. The difference between the forces provided by the back pressures in recess 14 and chamber 54 respectively increases as the input flow increases. Thus as the input flow increases, the distance the tubular element and nozzle element move with respect to sleeve 22 also increases. Consequently, the distance the air exiting orifice 55 travels before it merges with the air exiting the orifice 86, increases. This greater distance increases the amount of ambient air induced between the two orifices so as to increase thrust. As the input flow of pressurized air decreases, the action of compression spring 63 forces the tubular member back towards the retracted position. The extension and retraction of tubular member 34 thus optimizes the output thrust of the nozzle at various input flow rates.

As indicated earlier, the element 92 modifies the flow of air in bore 10B so that the main compressed air stream tends to form a laminar flow jet on passing through that element and out of the nozzle. Element 92 thus reduces the noise produced by the compressed air flowing inside of the nozzle through bores 10A and 10B.

The following example illustrates the extent of noise reduction and the range and magnitude of the thrust achieved by the present invention. A nozzle was made having a construction as shown in FIG. 1. The bores 10 and 10A had a diameter of 0.312 inch, while the bore 10B had a diameter of 0.156 inch, and two diametrically opposed ports 56 and two diametrically opposed ports 78 were provided each having a diameter of 0.09 inch. The minimum gap at the exit end of orifice 86 measured about 0.003 inch while the gap at the exit orifice 55 measured about 0.006 inch and the surfaces 80 and 82 extended at respective angles of 30° and 20° to the axis of bore 10B. The curvature of surface 84 in longitudinal section was substantially that of a circular arc and its apex was about 0.3 inches from the axis of bore 10B. The nozzle element 58, tubular member 34 and plug 2 were made of aluminum and the element 92 was made of two-ply stainless steel knitted wire mesh ribbon. Element 92 was formed in-situ in the manner above described and in its as-formed condition had a density of 40 percent of the density of the stainless steel wire making up the knitted wire mesh fabric. Element 92 had an axial length of about 0.25 inch. The plug 2 was connected to a 100 psi pressurized air supply and the noise and thrust of the nozzle were determined according to well known techniques. The noise level and thrust were measured at a point about 3 feet and at a point about 4 inches respectively downstream of the nozzle for various flow rates through the nozzle with the results as set forth.

TABLE I

| Input flow rate Through Nozzle (scfm) | Output Thrust (lbf) | Noise Level (dba) |
|---|---|---|
| 7 | .219 | 69.4 |
| 10.5 | .369 | 76.6 |
| 14.0 | .581 | 81.4 |
| 17.5 | .715 | 85.6 |
| 21.0 | .919 | 88.4 |

If noise is of no consequence, element 92 can be omitted or replaced with some other porous plug, e.g., plugs made of a porous ceramic, sintered metal, wire cloth or steel wool, which may or may not have some noise silencing effect but at least will create a back pressure sufficient to divert some of the high pressure air out of ports 78 and 56 as well as into space 51. If element 92 is entirely omitted, bore 10B may provide some of the needed back pressure since the bore 10B is formed with a reduced diameter section, but it would have to be modified to create the needed back pressure for the ports 78. This can be achieved in various ways, e.g. by forming the bore 10B with a reduced diameter section downstream of ports 78 or providing it with a baffle or other obstruction member for impeding air flow and thus creating a suitable back pressure.

Obviously the nozzle may be made in other ways than herein shown and described, Thus, for example, the shape and dimensions of the nozzle element, shell, tubular member and the plug may be varied and the latter may be adapted to be secured to a conduit by other than a screw connection. Further, although the orifice 55 formed between the tubular member 34 and shell 22 is preferred since it boosts the amount of air that is entrained, it is not absolutely necessary since the air discharged by orifice 86 acts to induce air flow along the exposed outer surface of tubular member 34. Also, more than one noise-reducing element may be installed in bore 10B as disclosed by copending U.S. patent application Ser. No. 388,636, filed Aug. 15, 1973 by Alain Frochaux and Charles M. Salerno for Noise-Reducing Fluid-Flow Device. Furthermore, while the illustrated nozzle is intended for use with air, it also may be used as a nozzle for other fluids.

What is claimed is:

1. A high-thrust low-noise nozzle adapted to effect movement of a secondary fluid by a pressurized primary fluid comprising, tubular means forming a passageway having an entrance and an exit orifice, said entrance being adapted for connection to a source of pressurized primary fluid, at least one port communicating with the passageway between said entrance and exit orifice, means cooperating with said port for directing flow of primary fluid from said port along the outside of said tubular means in a direction so as to induce flow of a secondary fluid along the outside of said tubular means toward said exit, noise-reducing means positioned in said passageway between said exit orifice and said port for effecting substantially laminar flow of the stream of pressurized primary fluid discharged from said exit orifice, said noise-reducing means creating sufficient back pressure to force some of the pressurized primary fluid to flow out of said passageway via said port, and means for varying the length of the outside of said tubular means over which secondary fluid flows as a function of the input flow of said primary fluid.

2. A nozzle according to claim 1 wherein said noise-reducing means comprises an element that is made up of a knitted metal wire mesh fabric that has been convoluted and compressed and molded into a self-supporting, dense, porous mass with the wire threads of said fabric oriented randomly in said mass.

3. A high-thrust, low-noise nozzle comprising a body having means defining a passageway, an entrance for admitting a pressurized primary fluid to said passageway, and an exit at one end of said body for discharging a stream of said primary fluid from said passageway, said body also having an exterior surface with a portion of said exterior surface disposed so as to converge toward said passageway at said one end, flow inducing means including at least one port communicating with said passageway between said exit and said entrance for conducting some of the pressurized primary fluid out of said passageway via said port and directing it along said portion of said exterior surface toward said one end so as to induce a secondary fluid surrounding said body to flow along said surface and merge with the stream of primary fluid discharged from said exit, and means for varying the length of said exterior surface along which said secondary fluid is induced to flow as a function of the input flow of said primary fluid.

4. A nozzle according to claim 3 wherein said flow-inducing means comprises an annular orifice communicating with said at least one port for directing fluid along said portion of said exterior surface toward said one end.

5. A nozzle according to claim 3 wherein said flow-inducing means comprises a second exterior surface on said body which is disposed so as to converge toward said passageway away from said exit end, and a transition surface that extends between said first and second mentioned exterior surfaces.

6. A nozzle according to claim 5 wherein said flow inducing means includes means spaced from said second exterior surface for directing primary fluid to flow from said port along said second exterior surface, so that substantially static secondary fluid surrounding said second exterior surface is induced to flow with primary fluid in turn over said transition surface and said first mentioned surface.

7. A nozzle according to claim 6 wherein said spaced means comprises an annulus surrounding and spaced from said body.

8. A nozzle according to claim 7 wherein said annulus surrounds the portion of said body that includes said port.

9. A nozzle according to claim 3 including a fluid-permeable element in said passageway between said exit and said port.

10. A nozzle according to claim 9 wherein said fluid permeable element comprises a compressed mass of a wire mesh fabric.

11. An amplifier air nozzle adapted to effect movement of a secondary fluid so as to produce a stream made up of said primary and secondary fluids at the exit of said nozzle, said nozzle comprising:

a sleeve having means defining a first passageway therethrough and an entrance for admitting a primary pressurized fluid to said first passageway;

tubular means forming a second passageway having an entrance and an exit, said tubular means being slidably disposed in said first passageway so as to be movable along its axis toward and away from the entrance of said first passageway between an extended position and a retracted position;

a first chamber between said tubular means and said sleeve, at least one port in said tubular means for conducting said primary fluid from said second passageway to said first chamber, a first narrow orifice formed between said sleeve and said tubular means for conducting said primary fluid in a thin stream out of said first chamber toward the exit end of said nozzle;

means for biasing said tubular means toward said retracted position;

an elongate body having a tapered exterior surface, said elongate body being secured to the exit end of said tubular means and having a longitudinally extending bore in said body forming a third passageway extending from said second passageway;

a second chamber between said tubular means and said body; at least one port in said body for conducting said primary fluid from said third passageway into said second chamber; a second narrow orifice formed between said tubular means and said body for conducting said primary fluid in a thin stream out of said second chamber and along said tapered exterior surface so as to induce a secondary fluid surrounding said housing to flow with said thin stream of said primary fluid along said tapered exterior surface toward said exit end of said nozzle and combine with the stream of said primary fluid discharged at said exit; and means for moving said tubular means from said retracted position toward said extended position by an amount proportional to the rate of flow of said primary fluid in said first passageway.

12. An air nozzle in accordance with claim 11, further including means disposed in said first chamber for maintaining said tubular means in a coaxial relationship with said first passageway.

13. An air nozzle in accordance with claim 12, wherein said means disposed in said first chamber comprises an annular guide ring surrounding said tubular means and providing at least one opening for discharging fluid from said first chamber.

14. An air nozzle in accordance with claim 13, wherein said means for biasing said tubular means also biases said guide ring adjacent said narrow first orifice.

15. An air nozzle in accordance with claim 11 wherein said tubular means includes a surface disposed transversely to the axis of said tubular means which is exposed to the air pressure in said second passageway, and further including flow modifying means for creating a back pressure in said passageways, the level of said back pressure being dependent upon the rate at which said primary fluid passes through said second passageway, said back pressure exerting a force on said surface of said tubular means so as to urge said tubular means toward said extended position.

* * * * *